US009039841B2

(12) United States Patent
Van Staden et al.

(10) Patent No.: US 9,039,841 B2
(45) Date of Patent: May 26, 2015

(54) CLEANING AND/OR UNBLOCKING OF PROCESS EQUIPMENT

(75) Inventors: Thomas Andries Scheepers Van Staden, Secunda (ZA); Johan Frederick Kirsten, Secunda (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 1176 days.

(21) Appl. No.: 12/747,847

(22) PCT Filed: Dec. 10, 2008

(86) PCT No.: PCT/IB2008/055203

§ 371 (c)(1),
(2), (4) Date: Jun. 11, 2010

(87) PCT Pub. No.: WO2009/074958

PCT Pub. Date: Jun. 18, 2009

(65) Prior Publication Data

US 2010/0269862 A1 Oct. 28, 2010

Related U.S. Application Data

(60) Provisional application No. 61/007,348, filed on Dec. 11, 2007.

(51) Int. Cl.

| | |
|---|---|
| ***B08B 9/00*** | (2006.01) |
| ***B08B 9/08*** | (2006.01) |
| ***C10G 2/00*** | (2006.01) |

(52) U.S. Cl.

CPC ..... *B08B 9/00* (2013.01); *B08B 9/0808* (2013.01); *B08B 9/0813* (2013.01); *C10G 2/344* (2013.01)

(58) Field of Classification Search

CPC ..... C10B 43/00; C10B 43/02; C10B 43/04; C10B 43/06; C10B 43/08; B08B 9/00; B08B 9/02; B08B 9/021; B08B 9/027; B08B 9/032

USPC ..... 134/6, 22.1, 22.18, 22.19, 24, 34

See application file for complete search history.

(56) References Cited

U.S. PATENT DOCUMENTS

| | | | | |
|---|---|---|---|---|
| 3,645,452 | A * | 2/1972 | Stoeckel et al. | 239/227 |
| 4,148,723 | A | 4/1979 | Mozley | |
| 4,828,651 | A * | 5/1989 | Lumbroso et al. | 201/2 |
| 5,129,455 | A * | 7/1992 | Boisture | 165/95 |

(Continued)

FOREIGN PATENT DOCUMENTS

| | | |
|---|---|---|
| WO | 9917885 | 4/1999 |

OTHER PUBLICATIONS

Corresponding International Search Report from corresponding priority PCT Application No. PCT/IP2008/055203 dated Mar. 30, 2009.

*Primary Examiner* — Michael Kornakov
*Assistant Examiner* — Ryan Coleman
(74) *Attorney, Agent, or Firm* — Thompson Coburn LLP

(57) ABSTRACT

A method of cleaning an internal component (14) of a process vessel (10) includes opening a guide (42) extending at least from a vessel access port or entry nozzle (38) to the internal component (14), guiding a cleaning agent/device by means of the guide (42) to the internal component (14), cleaning the internal component (14) with the cleaning agent/device, and closing the guide (42). The process vessel (10) is then operated with the guide (42) remaining in the process vessel (10).

7 Claims, 2 Drawing Sheets

(56) References Cited

U.S. PATENT DOCUMENTS

Figure 1:
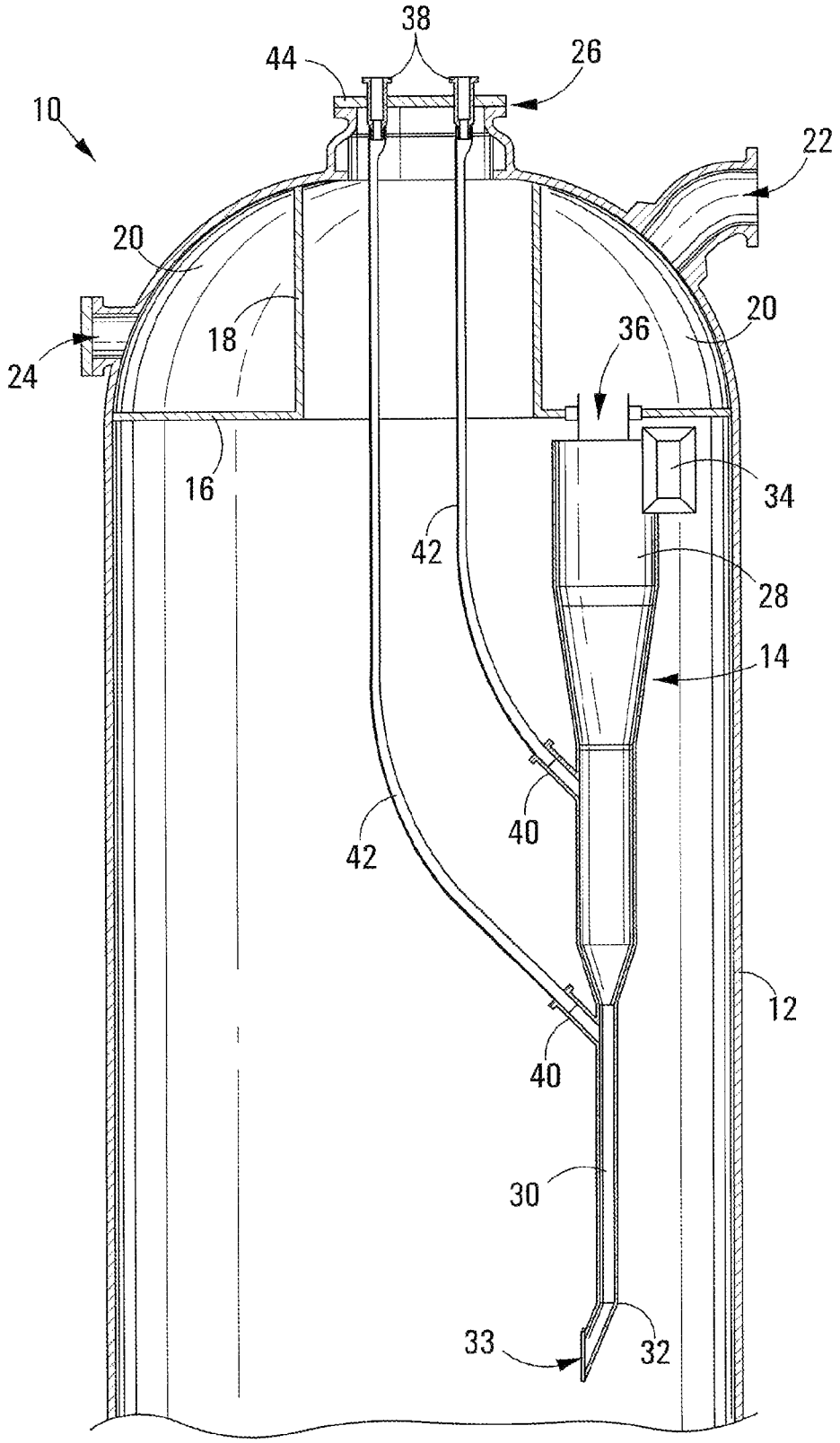

2004/0149318 A1 8/2004 Su
2005/0252528 A1* 11/2005 Richards et al. ..... 134/22.1
2008/0314413 A1* 12/2008 Wetzel et al. ..... 134/22.18

* cited by examiner

CLEANING AND/OR UNBLOCKING OF PROCESS EQUIPMENT

CROSS-REFERENCE TO RELATED APPLICATIONS

The present application claims the benefits of PCT/IB2008/055203, filed Dec. 10, 2008, and U.S. application Ser. No. 61/007,348, filed Dec. 11, 2007, both of which are entitled "CLEANING AND/OR UNBLOCKING OF PROCESS EQUIPMENT" and are incorporated herein by reference in their entireties.

THIS INVENTION relates to the cleaning and/or unblocking of process equipment. In particular, the invention relates to a method of cleaning an internal component of a process vessel, to a method of modifying a fluidized bed process vessel which includes an internal cyclone, and to a fluidized bed process vessel.

The Applicant commercially operates large fluidized bed reactors known as Sasol Advanced Synthol (SAS) reactors to convert synthesis gas to liquid fuels and chemicals. These reactors make use of cyclones located inside the reactors to remove entrained solids, typically catalyst particles, from product gas prior to the gas leaving the reactors, with the removed solids being returned to the fluidized beds inside the reactors via diplegs. Cyclone blockages have resulted in numerous unplanned reactor shutdowns. Generally a cyclone is unblocked through a person entering the reactor through a maintenance access way and effecting manual cleaning of the cyclone. Hence it will be appreciated that the open-clean-shut downtime required to clean a cyclone in a SAS reactor may require an extended period, resulting in lost production and a substantial loss in revenue. The Applicant believes that there are also other process vessels, especially very large process vessels, with internal components that require periodic cleaning or unblocking and for which a safer, less costly and less time consuming process than a person entering the vessel and cleaning the internal component would be desirable.

According to one aspect of the invention, there is provided a method of cleaning an internal component of a process vessel, the method including opening a guide extending at least from a vessel access port or entry nozzle to the internal component;

guiding a cleaning agent/device by means of said guide to the internal component;

cleaning the internal component with the cleaning agent/device; and closing said guide and operating the process vessel with the guide remaining in the process vessel.

Typically, the cleaning agent/device is guided into the internal component.

The process vessel may be a very large process vessel, e.g. a Fischer-Tropsch hydrocarbon synthesis fluidized bed vessel or reactor, such as e.g. a SAS reactor. In this specification, the expression "very large process vessel" is intended to refer to a process vessel of such dimensions as to require vessel entry by a person to reach said internal component for cleaning purposes, in the absence of said cleaning agent/device and said guide. Typically, a very large process vessel is a vessel with an internal height of at least 2 m, and an internal diameter of at least 2 m. The invention thus enables cleaning of the internal component of a very large process vessel, without a person having to enter the vessel.

The cleaning agent/device may include a cleaning lance or rod which is long enough to reach the internal component from outside the process vessel. In such embodiments of the invention, the guide typically is in the form of a conduit or sleeve, e.g. a curved metal pipe or flextalic tube, along which the rod is displaceable. The rod may comprise of segmented sections, and/or may be constructed of resiliently flexible material. Cleaning the internal component with the cleaning rod then typically comprises physically dislodging material to be removed from the internal component by displacement of the cleaning rod inside the guide. The cleaning rod may be manually displaced. When the cleaning agent/device includes a rod or lance, opening the guide may include removing a closure, e.g. a flange, to obtain access to the guide.

Preferably, the method includes removing the rod from the guide, and hence from the process vessel, once the internal component has been cleaned. The rod is thus typically removed prior to recommissioning or operating the process vessel.

The cleaning agent/device may instead be a cleaning fluid, e.g. compressed air, pressurized water or steam. As will be appreciated, for some embodiments of the invention in which the cleaning agent/device is a cleaning fluid, the guide defines a fluid flow path between the vessel access point and the internal component, or the guide includes a conduit defining a fluid flow path between the vessel entry nozzle and the internal component. Typically, flow of the cleaning fluid does not form part of the normal operation of the process vessel, and the flow of cleaning fluid is thus stopped prior to recommissioning or operating the process vessel. When the cleaning agent/device is a cleaning fluid, opening the guide may comprises opening an isolation valve to allow cleaning fluid to enter the guide from external of the process vessel.

In yet a further alternative, the cleaning agent/device includes a conduit, the method including guiding the conduit by means of said guide to the internal component and cleaning the internal component or assisting in cleaning the internal component with a cleaning fluid flowing along the conduit.

The cleaning fluid may be as hereinbefore described. In such embodiments of the invention, the guide typically is in the form of a conduit or sleeve, e.g. a curved metal pipe or flextalic tube, along which the conduit is displaceable.

The method may include visually inspecting the internal component with a boroscope guided to the internal component by means of the guide as hereinbefore described. Where appropriate, the boroscope may form part of the cleaning agent/device as hereinbefore described, or may be carried by the cleaning agent/device.

The internal component may be a cyclone.

The method may include guiding the cleaning agent/device through a dedicated cleaning nozzle into the internal component. When the internal component is a cyclone, the cleaning nozzle may be located on a dipleg of the cyclone.

The vessel entry nozzle may be located on a wall of the process vessel. Preferably however, the vessel entry nozzle is located on a closure of an access port of the process vessel. Advantageously, such a closure typically provides a flat surface on which the vessel entry nozzle can be welded. The access port may be of a size sufficiently large to allow a person to enter the process vessel, i.e. it may be a man-hole.

The vessel entry nozzle may be above, but horizontally set off from the internal component. The guide may thus define a curved guide path between the vessel entry nozzle and the internal component.

Cleaning the internal component with the cleaning agent/device may include removing deposits lodged within the internal component. In particular, cleaning the internal component with the cleaning agent may include removing a catalyst particle blockage from the internal component, and more particularly from a cyclone inside the process vessel. The catalyst particle blockage may be a Fischer-Tropsch catalyst particle blockage.

According to another aspect of the invention, there is provided a method of modifying a fluidized bed process vessel which includes an internal cyclone, the method including installing a guide between a vessel entry nozzle and the internal cyclone, the guide being configured to guide a cleaning agent/device from outside the process vessel to the internal cyclone.

Once installed, the guide forms an integral part or permanent feature of the process vessel, and thus enables cleaning of the internal cyclone without a person having to enter the process vessel.

The method may include installing also the vessel entry nozzle on the process vessel. Although in principle possible to install the vessel entry nozzle on a wall of the process vessel, this may be difficult and/or expensive, particularly if the wall is curved and/or heat treatment of the welded area is required. Preferably, the vessel entry nozzle is installed on a detachable closure member of an access port of the process vessel. The access port may be as hereinbefore described.

The vessel entry nozzle may be above but horizontally set off from the internal cyclone.

The process vessel may include a plurality of internal cyclones and an annular clean gas collection chamber for the cyclones. The guide may be in the form of a conduit or sleeve, e.g. a curved metal pipe or flextalic tube. The guide may be installed to pass through an opening defined centrally in an internal radially extending annular wall of the process vessel defining said annular clean gas collection chamber for the cyclones. The cyclones may be suspended from the annular wall.

The method may include installing a dedicated cleaning nozzle on the internal cyclone, with the guide extending between the vessel entry nozzle and the dedicated cleaning nozzle on the internal cyclone. The dedicated cleaning nozzle may be located on a dipleg of the internal cyclone. The dedicated cleaning nozzle may include a self-sealing closure which closes when the cleaning agent is removed from the guide or is no longer being introduced into the guide.

According to a further aspect of the invention, there is provided a fluidised bed process vessel, the process vessel including an internal component, a vessel entry nozzle, and a guide to guide a cleaning agent/device from external of the process vessel through the vessel entry nozzle to the internal component to allow periodic cleaning of the internal component.

The guide forms an integral part or permanent feature of the process vessel. The guide thus enables cleaning of the internal component without a person having to enter the process vessel.

The process vessel may be a very large process vessel as hereinbefore defined.

The internal component may be a cyclone.

The guide may be configured to guide a lance or rod from the vessel entry nozzle to the internal component. In such embodiments of the invention, the guide typically is in the form of a conduit or sleeve, e.g. a curved metal pipe or flextalic tube, along which the rod is displaceable.

Instead, or in addition, the guide may define a fluid-flow path between the vessel entry nozzle and the internal component, or the guide may include a conduit defining a fluid-flow path between the vessel entry nozzle and the internal component.

In yet a further alternative, the guide may be configured to guide a cleaning agent/device which defines a conduit configured to carry a cleaning fluid to the internal component. In such embodiments of the invention, the guide typically is in the form of a conduit or sleeve, e.g. a curved metal pipe or flextalic tube, along which the conduit is displaceable.

The internal component may include a dedicated cleaning nozzle on the internal component. The cleaning nozzle may be as hereinbefore described.

The vessel entry nozzle may be as hereinbefore described.

The process vessel may include a plurality of internal components in the form of cyclones, an annular clean gas collection chamber, and a plurality of guides, each guide being in the form of a conduit or sleeve which passes through an opening defined centrally in an internal radially extending annular wall of the process vessel defining said annular clean gas collection chamber for the cyclones. Each guide may be in the form of a curved metal pipe or flextalic tube. The cyclones may be suspended from the annular wall.

Figure 2:
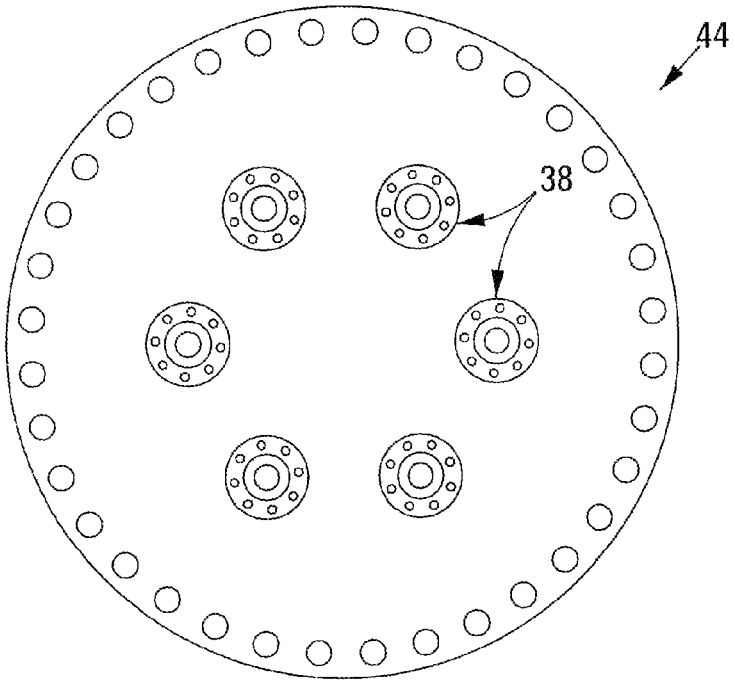
Figure 3:
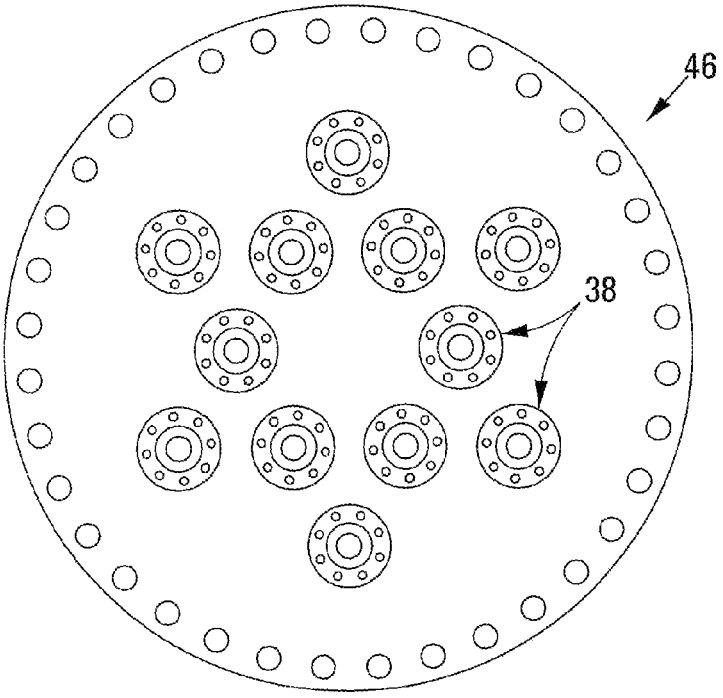

The invention will now be described, by way of example, with reference to the accompanying diagrammatic drawing in which FIG. 1 shows a vertically sectioned view of an upper portion of a fluidized bed process vessel suitable for Fischer-Tropsch synthesis, in accordance with the invention;

FIG. 2 shows a top plan view of an access port closure of the vessel of FIG. 1; and FIG. 3 shows a top plan view of another embodiment of an access port closure for a fluidised bed process vessel.

Referring to FIG. 1 of the drawings, reference numeral 10 generally indicates an upper portion of a fluidised bed process vessel suitable for Fischer-Tropsch synthesis, in accordance with the invention. The drawing shown in FIG. 1 is simplified with parts or features of the vessel 10 having been omitted for clarity. The inventive features of the vessel 10 are however clearly shown.

The vessel 10 includes a reactor shell 12, only an upper portion of which is shown which houses a plurality of internal components in the form of internal cyclones 14, only one of which is shown. The cyclones 14 are suspended from a radially extending annular wall 16 which, together with an internal circular cylindrical wall 18 and the reactor shell 12 define a clean gas collection chamber 20 for the cyclones.

A clean gas outlet 22 leads from the clean gas collection chamber 20 through the reactor shell 12. Maintenance access ports 24, 26 are also provided on the reactor shell 12. The maintenance access port 26 is a man-hole and is typically used to lower cyclones into the vessel 10.

The cyclone 14 has a dust bowl 28 and a dipleg 30 depending downwardly from the dust bowl 28. In the embodiment of the cyclone 14 shown in FIG. 1, the dipleg 30 has a mitred bend 32 at a lower end thereof. An outlet of the dipleg 30 is covered by a trickle valve 33. A gas inlet 34 leads into the dust bowl 28 and a gas outlet 36 leads from the dust bowl 28 through the annular wall 16 into the clean gas collection chamber 20.

The vessel 10 has an internal diameter of typically larger than 8 meter. It is thus a large process vessel.

The vessel 10 serves as a dense phase turbulent fluidised bed reactor used to convert synthesis gas to liquid fuels and chemicals. In use, synthesis gas enters the reactor shell 12 at a bottom thereof and passes through a grid plate or gas distributor (not shown) and fluidises a catalyst bed (not shown), which operates in the turbulent fluidisation regime. The gas distributor serves to distribute the gas evenly throughout the catalyst bed thus preventing preferential flow patterns and stagnant regions. It also acts as a support for the catalyst bed during bed slump. In the fluidised bed, Fischer-Tropsch and side reactions occur, which result in a host of gaseous products. These reactions are exothermic; hence cooling coils (not shown) are present in the vessel 10 to remove heat by generating steam in the coils. Product gas leaves the fluidised bed carrying some catalyst particles entrained in the gas. The gas is thus passed through the cyclones 14 to separate the entrained solids from the product gas. Thus, gas enters the cyclones 14 through the gas inlets 34 with the entrained solids being separated in the dust bowls 28 by means of cyclonic action and the clean gas leaving the cyclones 14 through the gas outlets 36. The clean gas from all of the cyclones 14 is collected in the clean gas collection chamber 20 and removed from the vessel 10 through the clean gas outlet 22.

The catalyst solid particles, separated from the product gas by centrifugal forces in the cyclones 14, flow downwardly into the dipleg 30. During the separation process there is a pressure drop which results in the pressure inside the cyclones 14 being less than the freeboard pressure inside the vessel 10. It is thus essential that there is a pressure recovery in the dipleg 30 to return the solids to the fluidised bed. This requires a head of solids in the dipleg 30, above the trickle valve 33. As these solids flow down the dipleg 30, the pressure at the trickle valve 33 increases and when this pressure is greater than the freeboard pressure, the trickle valve 33 opens, causing the solids to flow out into the fluidised bed.

The combination of the cohesive nature of Fischer-Tropsch synthesis catalyst and low solids flux through the diplegs 30 causes non-aerated catalyst near the trickle valve 33 to settle and compact with time. When a mitred bend such as the mitred bend 32 is present, the problem is exacerbated, from time to time causing cyclone blockages.

In order to ensure that it is not necessary to enter the vessel 10 in order to clear a cyclone blockage, the vessel 10, in accordance with the invention, is provided with vessel entry nozzles 38, cleaning nozzles 40 on the cyclones 14 and guides 42 extending between the vessel entry nozzles 38 and associated cleaning nozzles 40.

The vessel entry nozzles 38 are provided on a closure 44 of the maintenance access port 26. Advantageously, the closure 44 provides a flat surface for the welding of the vessel entry nozzles 38 and it is only necessary to subject the closure 44 with the welded vessel entry nozzles 38 to heat treatment. This situation is to be contrasted to the situation where the vessel entry nozzles 38 are welded to the reactor shell 12 which would require heat treatment of the reactor shell 12 which would be extremely expensive.

FIG. 2 shows the arrangement of six vessel entry nozzles 38 on the closure 44, for a vessel, such as the vessel 10, which has three cyclones 14. FIG. 3 shows the arrangement of the vessel entry nozzles 38 for a closure 46 for a vessel, such as the vessel 10, which has six cyclones 14.

The guides 42 are in the form of flextalic tubes which define a gentle and gradual curve between the vessel entry nozzles 38 and the cleaning nozzles 40. Typically, the distance between the vessel entry nozzles 38 and the cleaning nozzles 40 vary between about 15 m and about 20 m.

When a cyclone blockage occurs, the vessel 10 is decommissioned, the blanked off vessel entry nozzles 38 are opened and a cleaning agent/device in the form of a flexible cleaning rod or lance is inserted through one of the vessel entry nozzles 38 and guided by means of the guide 42 through the associated cleaning nozzle 40 into the dipleg 30 of the cyclone 14. The rod is then used to dislodge the blockage. Once the cyclone 14 has been cleaned, the cleaning rod is removed from the guide 42 and the vessel entry nozzle 48 is blanked off again. This process can be repeated for as many of the vessel entry nozzles 38 as required. The guide 42 is not removed following cleaning of the cyclone 14, but remains in the vessel 10. The guide 42 is thus an integral part or permanent feature of the vessel 10.

As will be appreciated, instead of using a cleaning rod, it is also possible to force a fluid, such as compressed air or water, through the guides 42 to clean the cyclones 14. In such a case, the guides 42 may be connected to conduits external to the vessel 10 via valves (not shown), with cleaning simply being effected by opening the valves and hence opening the guides 42 to allow a compressed cleaning fluid to flow along the guides 42 to the cyclones 14.

If the guide 42 does not itself define a fluid flow path, e.g. if the guide 42 is apertured or the like, it is possible to guide a conduit along the guide 42 so the conduit extends between a vessel entry nozzle 38 and a cleaning nozzle 40, allowing cleaning by means of a fluid. The conduit may even be in the form of a rod, with cleaning of the cyclones 14 then being effected by physical displacement of the rod and by forcing a cleaning fluid through the rod.

If desired, a boroscope guided by the guide 42 may be used visually to inspect the cyclone 14 before, during and/or after cleaning. Advantageously, the boroscope may form part of the cleaning rod or may be carried by the cleaning rod.

The vessel 10, using the method of the invention, can be cleaned in approximately 12 hours, i.e. it is necessary to decommission the vessel 10 for a period of approximately 12 hours whilst cleaning is carried out. This is a significant reduction in lost production time taking into account the typical open-clean-shut downtime for a conventional vessel of this nature which does not include the vessel entry nozzles 38, guides 42 and cleaning nozzles 40. As will be appreciated, in view of the relatively short time required to conduct a cleaning operation in accordance with the invention, the cleaning operation can also be conducted as a preventative measure, e.g. on a weekly or monthly basis to clear away catalyst particles that may lead to a complete blockage if left unattended.

The invention claimed is:

1. A method of cleaning an internal cyclone of a fluidized bed process vessel, the method including:

opening a permanent guide which forms an integral feature of the process vessel and which extends at least from an externally accessible vessel access port or entry nozzle to the internal cyclone of the process vessel, the internal cyclone comprising a gas inlet and a gas outlet;

guiding at least one of a cleaning agent and a cleaning device by means of said permanent guide to the internal cyclone, the guiding occurring in a manner such that the cleaning agent or the cleaning device reaches into the internal cyclone without entering either the gas inlet or gas outlet of the internal cyclone;

cleaning the internal cyclone with said at least one of a cleaning agent and a cleaning device;

closing said guide; and operating the fluidized bed process vessel with said permanent guide remaining in the fluidized bed process vessel.

2. The method as claimed in claim 1, in which said at least one of a cleaning agent and a cleaning device includes a cleaning rod which is long enough to reach the internal cyclone from outside the fluidized bed process vessel, and wherein cleaning the internal cyclone comprises physically dislodging material to be removed from the internal cyclone by displacement of the cleaning rod inside the guide.

3. The method of as claimed in claim 1, in which said at least one of a cleaning agent and a cleaning device is a cleaning fluid, and the guide defines a fluid flow path between the vessel access port or entry nozzle and the internal cyclone.

4. The method as claimed in claim 1, in which said at least one of a cleaning agent and a cleaning device includes a conduit, the method including guiding the conduit by means of said guide to the internal cyclone and cleaning the internal cyclone with a cleaning fluid flowing along the conduit.

5. The method as claimed in claim 1, further comprising guiding said at least one of a cleaning agent and a cleaning device through a dedicated cleaning nozzle provided on the internal cyclone into the internal cyclone, the cleaning nozzle being located on a dipleg of the internal cyclone.

6. The method as claimed in claim 1, in which the vessel access port or entry nozzle is an entry nozzle located on a closure of an access port of the process vessel.

7. The method as claimed in claim 1, in which said at least one of a cleaning agent and a cleaning device is a cleaning device, the method including removing the cleaning device from said guide prior to closing said guide.

* * * * *